US010563658B2

(12) United States Patent
Lin et al.

(10) Patent No.: US 10,563,658 B2
(45) Date of Patent: Feb. 18, 2020

(54) BLOWER AND EXHAUST FAN COMPRISING THE SAME

(71) Applicant: Zhongshan Broad-Ocean Motor Co., Ltd., Zhongshan (CN)

(72) Inventors: Yanhu Lin, Zhongshan (CN); Weihao Wu, Zhongshan (CN); Haixiu Liao, Zhongshan (CN); Jianhui Li, Zhongshan (CN); Jian Lan, Zhongshan (CN); Huixiu Chen, Zhongshan (CN)

(73) Assignee: ZHONGSHAN BROAD-OCEAN MOTOR CO., LTD., Zhongshan (CN)

( * ) Notice: Subject to any disclaimer, the term of this patent is extended or adjusted under 35 U.S.C. 154(b) by 101 days.

(21) Appl. No.: 15/859,276

(22) Filed: Dec. 29, 2017

(65) Prior Publication Data

US 2018/0187686 A1 Jul. 5, 2018

(30) Foreign Application Priority Data

Jan. 4, 2017 (CN) ..... 2017 2 0013132 U
Mar. 13, 2017 (CN) ..... 2017 2 0243466 U

(51) Int. Cl.

| | |
|---|---|
| ***F04D 17/16*** | (2006.01) |
| ***F04D 29/70*** | (2006.01) |
| ***F04D 29/053*** | (2006.01) |
| ***F04D 29/16*** | (2006.01) |
| ***F04D 29/28*** | (2006.01) |
| ***F04D 29/42*** | (2006.01) |
| *F04D 29/62* | (2006.01) |

(52) U.S. Cl.

CPC ..... *F04D 17/164* (2013.01); *F04D 29/053* (2013.01); *F04D 29/162* (2013.01); *F04D 29/282* (2013.01); *F04D 29/424* (2013.01); *F04D 29/703* (2013.01); *F04D 29/626* (2013.01); *F05D 2250/51* (2013.01); *F05D 2250/52* (2013.01)

(58) Field of Classification Search

CPC .. F04D 29/4226; F04D 29/424; F04D 29/162; F04D 29/703; F04D 29/282; F04D 29/053; F04D 29/4293; F04D 29/4246; F04D 17/164; F05D 2250/51; F05D 2250/52

See application file for complete search history.

(56) References Cited

U.S. PATENT DOCUMENTS 3,775,029 A * 11/1973 Ranz ..... F04D 25/06 417/353
8,235,668 B2 * 8/2012 Shirahama ..... F04D 29/283 415/205
9,416,989 B1 * 8/2016 Tom ..... F24F 13/078

* cited by examiner

*Primary Examiner* — Richard A Edgar
*Assistant Examiner* — Maxime M Adjagbe
(74) *Attorney, Agent, or Firm* — Matthias Scholl P.C.; Matthias Scholl

(57) ABSTRACT

A blower, including: a volute including air inlets and an air outlet; a wind wheel disposed in the volute; and air collectors. Each air collector includes a curved air guide. The air inlets are disposed at two sides of the wind wheel, respectively. The air collectors correspond to the air inlets. The curved air guide extends into the volute, and the inner diameter of the curved air guide decreases stepwise. The relationship between a minimum inner diameter D0 of the curved air guide and an inner diameter D1, an outer diameter D2 of the wind wheel fulfills the following formula: $D1+\frac{1}{3}(D2-D1)\leq D0\leq D1+\frac{2}{3}(D2-D1)$. An exhaust fan that includes the blower is also provided.

16 Claims, 15 Drawing Sheets

BLOWER AND EXHAUST FAN COMPRISING THE SAME

CROSS-REFERENCE TO RELATED APPLICATIONS

Pursuant to 35 U.S.C. § 119 and the Paris Convention Treaty, this application claims foreign priority benefits to Chinese Patent Application No. 201720013132.7 filed Jan. 4, 2017, and to Chinese Patent Application No. 201720243466.3 filed Mar. 13, 2017. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The disclosure relates to a blower and an exhaust fan comprising the same.

Description of the Related Art

As shown in FIGS. 1 and 2, a typical exhaust fan includes a box h, a blower a disposed in the box h, and a transfer tube j protruding from the side wall of the box h. The transfer tube j includes a first opening j1 and a second opening j2. The first opening j1 is connected to the air outlet of the blower a, the transfer tube j is horizontally placed, and the first t opening j1 and the second opening j2 are basically in the same plane. The blower a includes a volute g and a wind wheel b disposed in the volute g. The volute g includes air inlets c and an air outlet k. The air inlets are located at two sides of the wind wheel b. A tubular air collector is disposed in each of the air inlets c. The inner diameter of the tubular air collector decreases gradually from outside to inside. There is a space f between the terminal of the air collector and two end faces of the wind wheel b. The minimum inner diameter d1 of the air collector is equal to the inner diameter d2 of the wind wheel b. In operation, when the wind wheel b rotates, a low pressure end is formed in the air inlets c, while a high pressure end is formed in the volute g. The air at the high pressure end flows to the low pressure end via the space f. This leads to air flow back and volume loss, decreases the work efficiency of the blower, and increases the noise of the blower and the exhaust fan.

SUMMARY OF THE INVENTION

In view of the above-described problems, it is one objective of the invention to provide a blower that has a relatively low volume loss and low noise, and relatively high work efficiency.

It is another objective of the invention to provide an exhaust fan comprising the blower, To achieve the above objectives, in accordance with one embodiment of the invention, there is provided a blower, comprising: a volute comprising air inlets and an air outlet; a wind wheel disposed in the volute; and air collectors, each air collector comprising a curved air guide. The air inlets are disposed at two sides of the wind wheel, respectively; the air collectors correspond to the air inlets; the curved air guide extends into the volute, and an inner diameter of the curved air guide decreases stepwise; and a relationship between a minimum inner diameter D0 of the curved air guide and an inner diameter D1, an outer diameter D2 of the wind wheel fulfills the following formula:

$$D1+\tfrac{1}{3}(D2-D1)\leq D0\leq D1+\tfrac{2}{3}(D2-D1).$$

In a class of this embodiment, the wind wheel comprises an outer surface and an inner surface, two ends of the outer surface protrude outwards radially to form a flange; two ends of the inner surface protrude towards the air inlets to form an air-blocking boss.

In a class of this embodiment, a space is disposed between an end face of the wind wheel and a terminal of the curved air guide, and a relation between a height C1 of the boss and a depth C2 of the space fulfills the following formula: $0<C1\leq\tfrac{1}{2}C2$.

In a class of this embodiment, the relation between the minimum inner diameter D0 of the curved air guide and the inner diameter D1, the outer diameter D2 of the wind wheel fulfills the following formula: $D0=\tfrac{1}{2}(D1+D2)$.

Another embodiment of the invention provides an exhaust fan, comprising: a box comprising a side wall, the above blower that is disposed in the box, and a transfer tube connected to the side wall of the box.

In a class of this embodiment, the transfer tube comprises a tube wall, and a first opening and a second opening that are connected to two ends of the tube wall; the first opening communicates with the air outlet of the volute, and the first opening is parallel to the second opening; and the second opening shifts towards a horizontal central axis of the box in relation to the air outlet.

In a class of this embodiment, assume a height of the air outlet is H2, and then an offset H1 of a central axis of the second opening shifting towards the horizontal central axis of the box in relation to the air outlet fulfills the following formula: $0.1\leq H1/H2\leq 0.5$.

In a class of this embodiment, a width of the transfer tube is less than a thickness of the box.

In a class of this embodiment, the tube wall comprises a tilt section and a transition section; the first opening is located on one end of the tilt section, and the second opening is located on one end of the transition section; the title section is inclined to the horizontal central axis, and the transition section is parallel to the horizontal central axis.

In a class of this embodiment, the first opening is square in shape, the transition section is a circular tube, and the second opening is circular in shape.

In a class of this embodiment, the box comprises a mounting hole, the transfer tube is mounted on the box via the mounting hole; one end of the transfer tube corresponding to the first opening protrudes outwards to form a first flange, the first flange is fixed on an inner surface of the side wall of the box, and the tilt section and the second opening are outside the box.

In a class of this embodiment, the box is equipped with a fixed bolt, the volute comprises a second flange surrounding the air outlet, an edge of the second flange comprises a fixed groove corresponding to the fixed bolt; the second flange presses the first flange on the inner surface of the side wall of the box, and the volute and the transfer tube are fixed on the box via the fixed bolt.

Advantages of the blower and the exhaust fan comprising the same according to embodiments of the invention are summarized as follows:

1. The curved air guide of the blower is modified, and a relationship between a minimum inner diameter D0 of the curved air guide and an inner diameter D1, an outer diameter D2 of the wind wheel fulfills the following formula: $D1+\frac{1}{3}(D2-D1)\leq D0\leq D1+\frac{2}{3}(D2-D1)$, so that, the wind resistance between the wind wheel and the air collectors is increased, thus effectively reducing the volume loss of the blower and improving the working efficiency of the blower.

2. The air-blocking boss on the outer end face of the wind wheel increases the wind resistance between the volute and the space, reduces unwanted air flow and reduces the noise of the blower.

3. The wind wheel of the exhaust fan is upgraded in structure, improving the exhaust efficiency and reducing the noise.

4. The second opening shifts towards the horizontal central axis of the box in relation to the air outlet, which can eliminate the whirlpool noise and turbulence at the air outlet of the volute, tests show that the noise can be reduced by 1 db.

5. A static pressure plate with good static pressure recovery effect is formed at the bottom of the transfer tube, improving the static pressure and the efficiency of the blower, and effectively reducing the input power of the motor.

6. The second flange of the volute presses the first flange on the inner surface of the side wall of the box, and the volute and the transfer tube are fixed on the box via the fixed bolt. Thus, the exhaust fan is a relatively simple structure and is easy to assemble.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a blower and an exhaust fan comprising the same are described below.

Example 1

Figure 1:
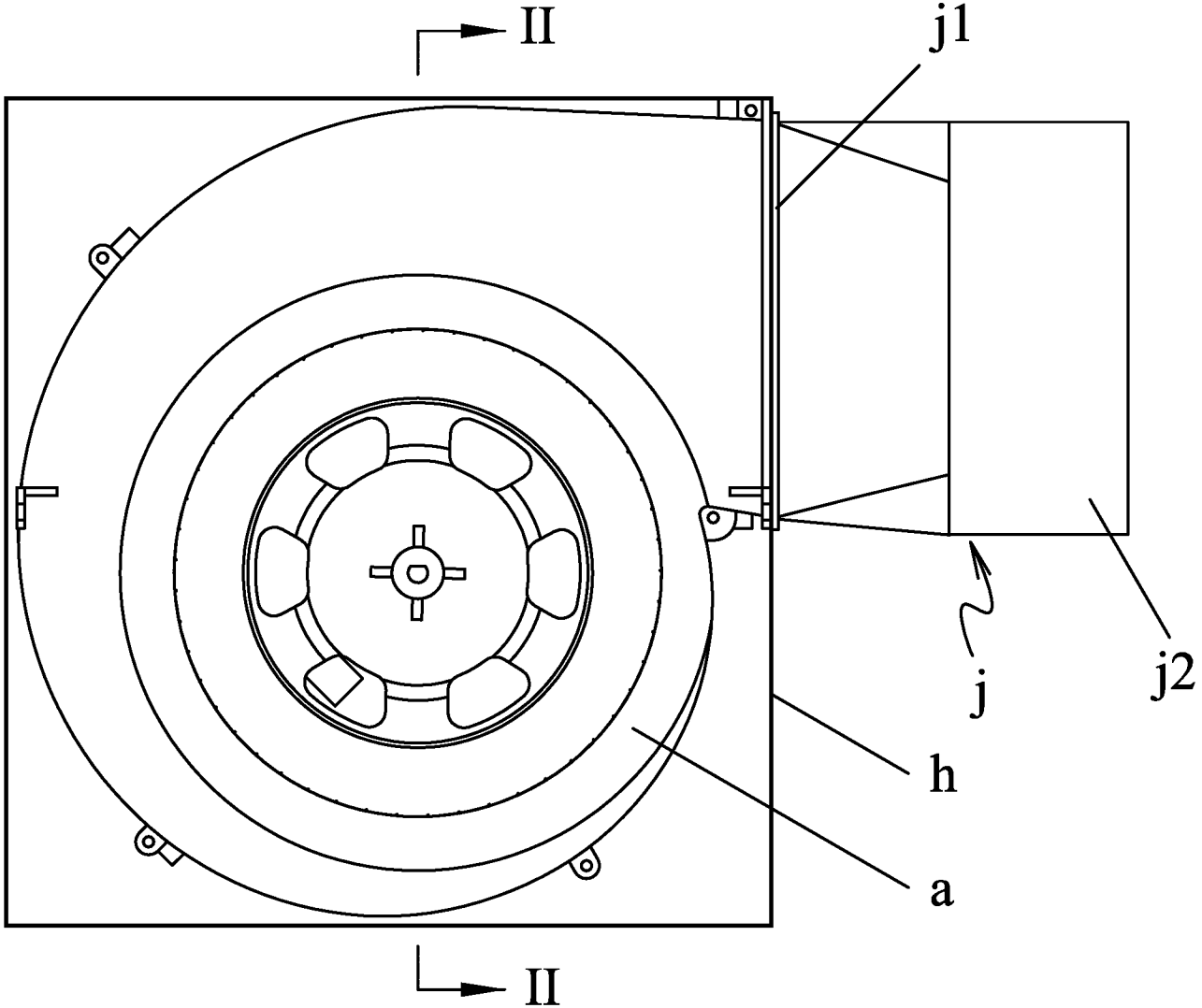
FIG. 1 (Prior art)
FIG. 1 is a sectional view of an exhaust fan in the prior art.
Figure 2:
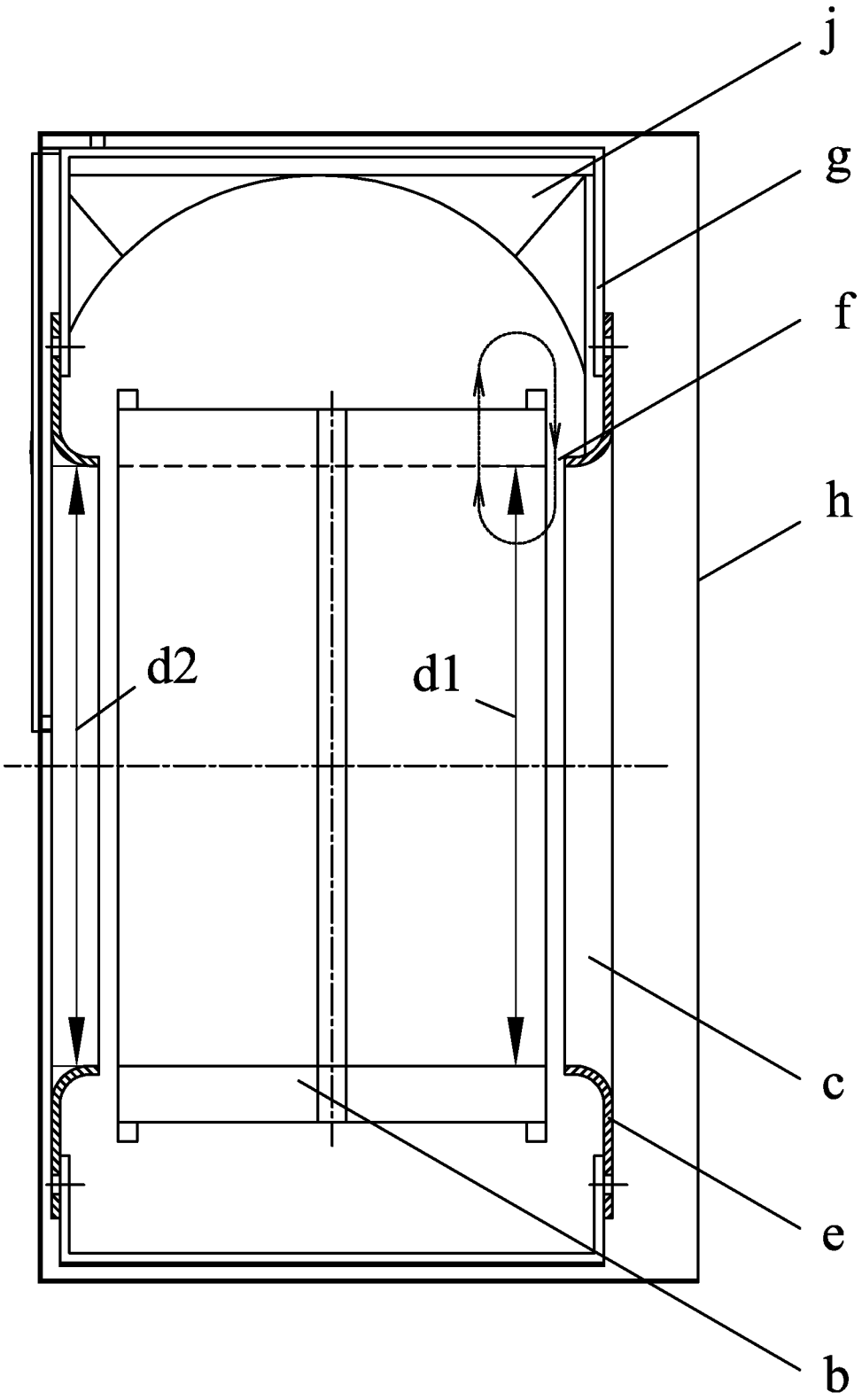
FIG. 2 (Prior art)
FIG. 2 is a sectional view taken from line II-II in FIG. 1.
Figure 3:
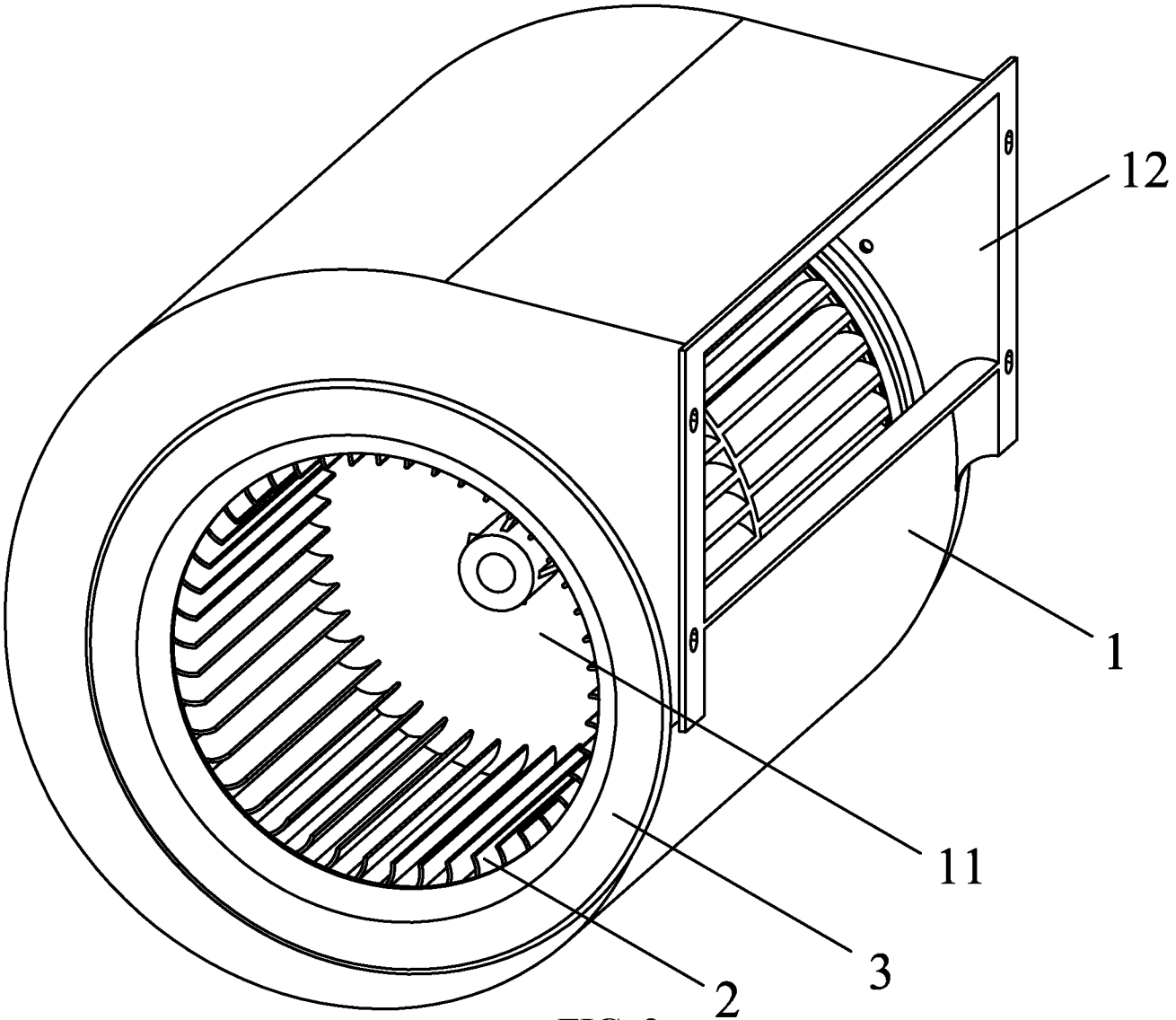
FIG. 3 is a stereogram of a blower in accordance with one embodiment of the disclosure.
Figure 4:
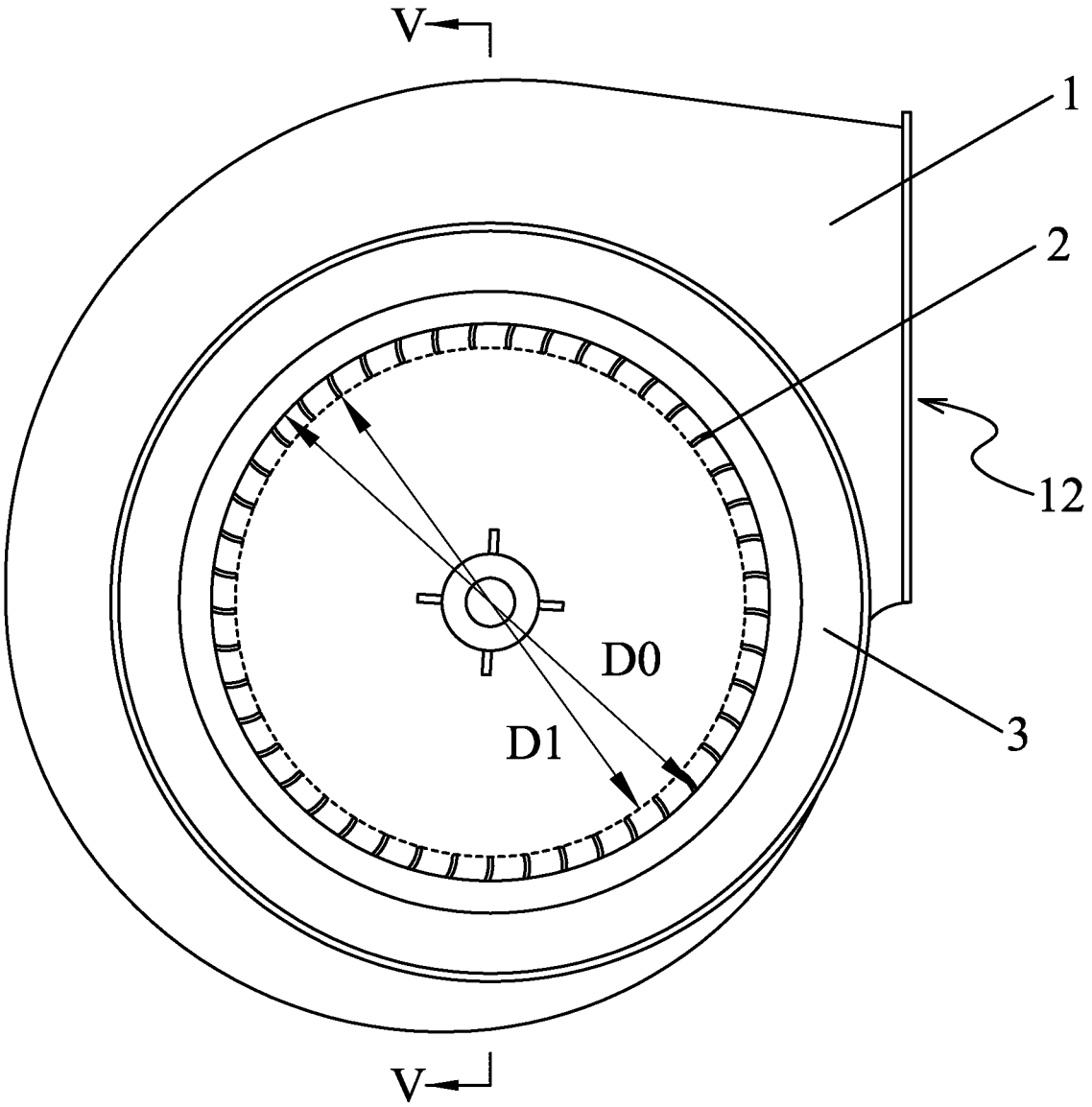
FIG. 4 is a front view of a blower in accordance with one embodiment of the disclosure.
Figure 5:
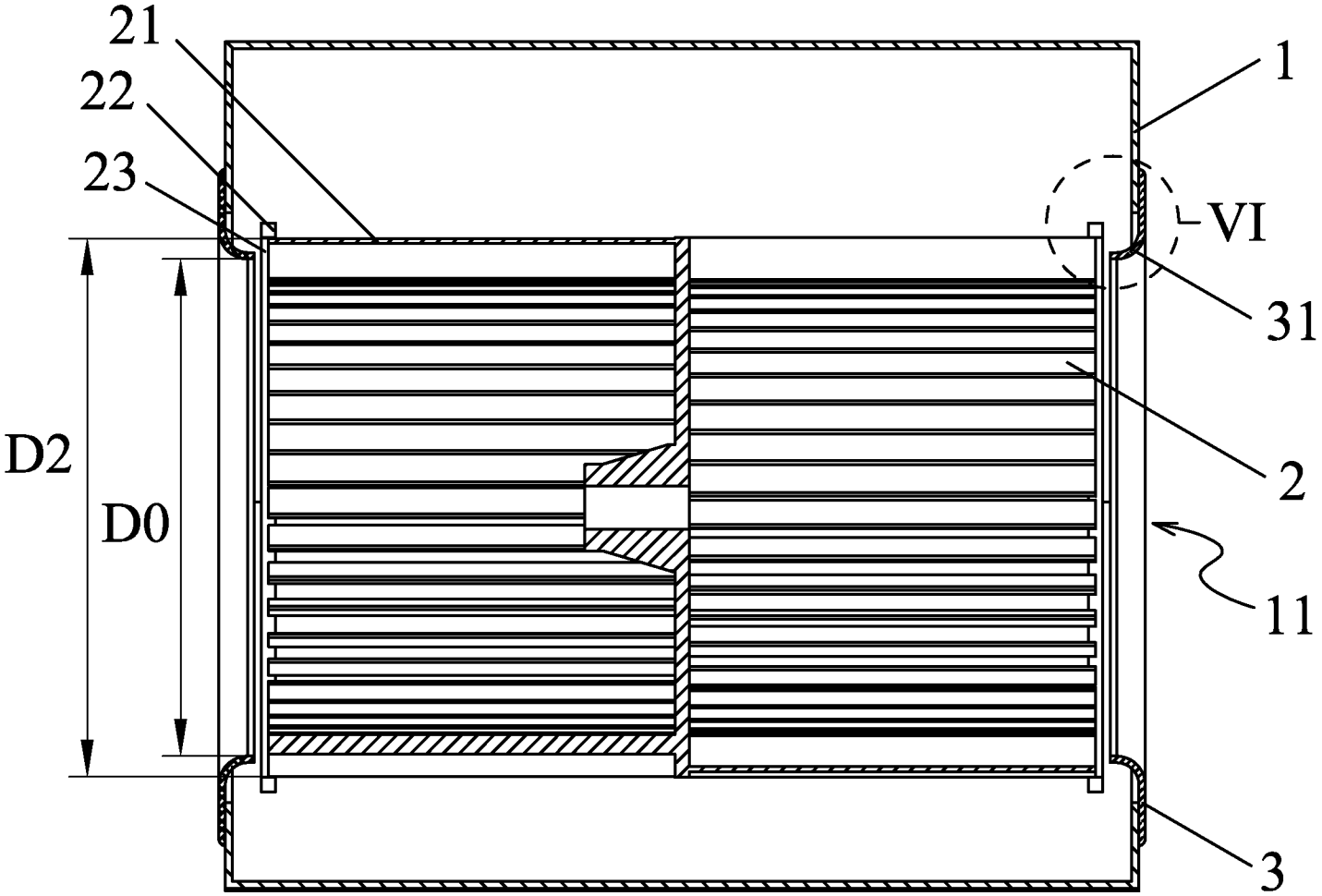
FIG. 5 is a sectional view taken from line V-V in FIG. 4.
Figure 6:
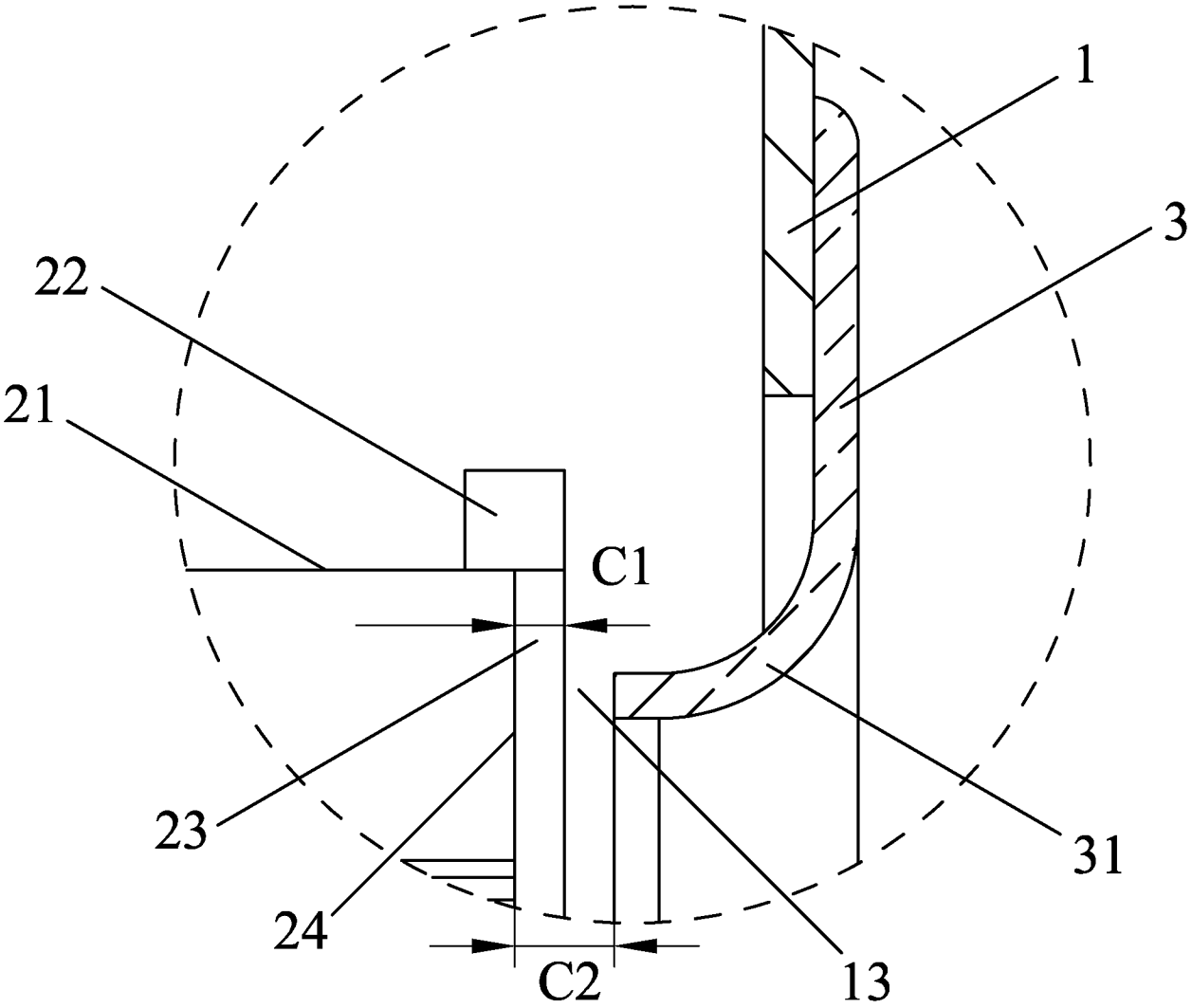
FIG. 6 is an enlarged view of part VI in FIG. 5.
Figure 7:
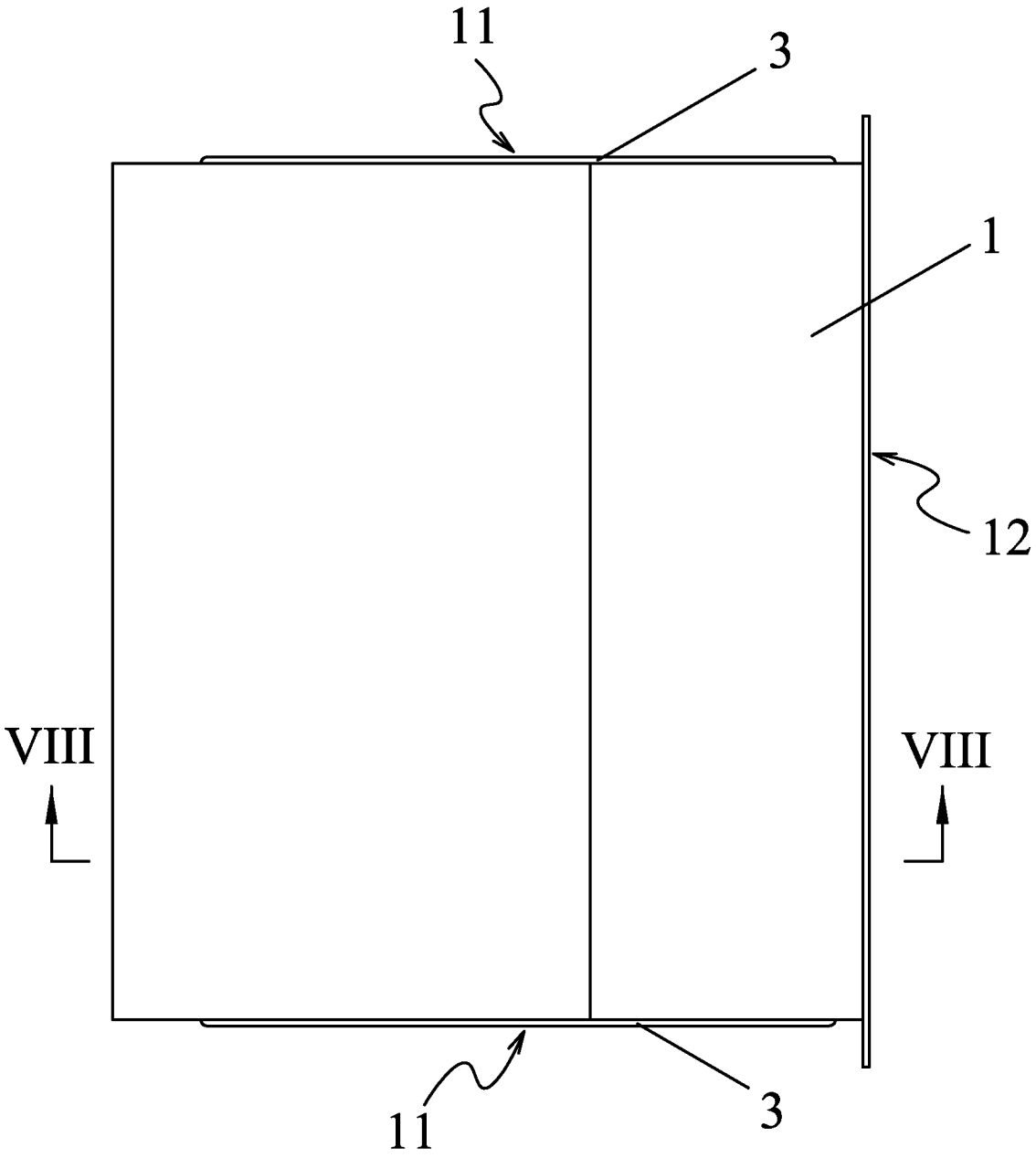
FIG. 7 is a top view of a blower in accordance with one embodiment of the disclosure.
Figure 8:
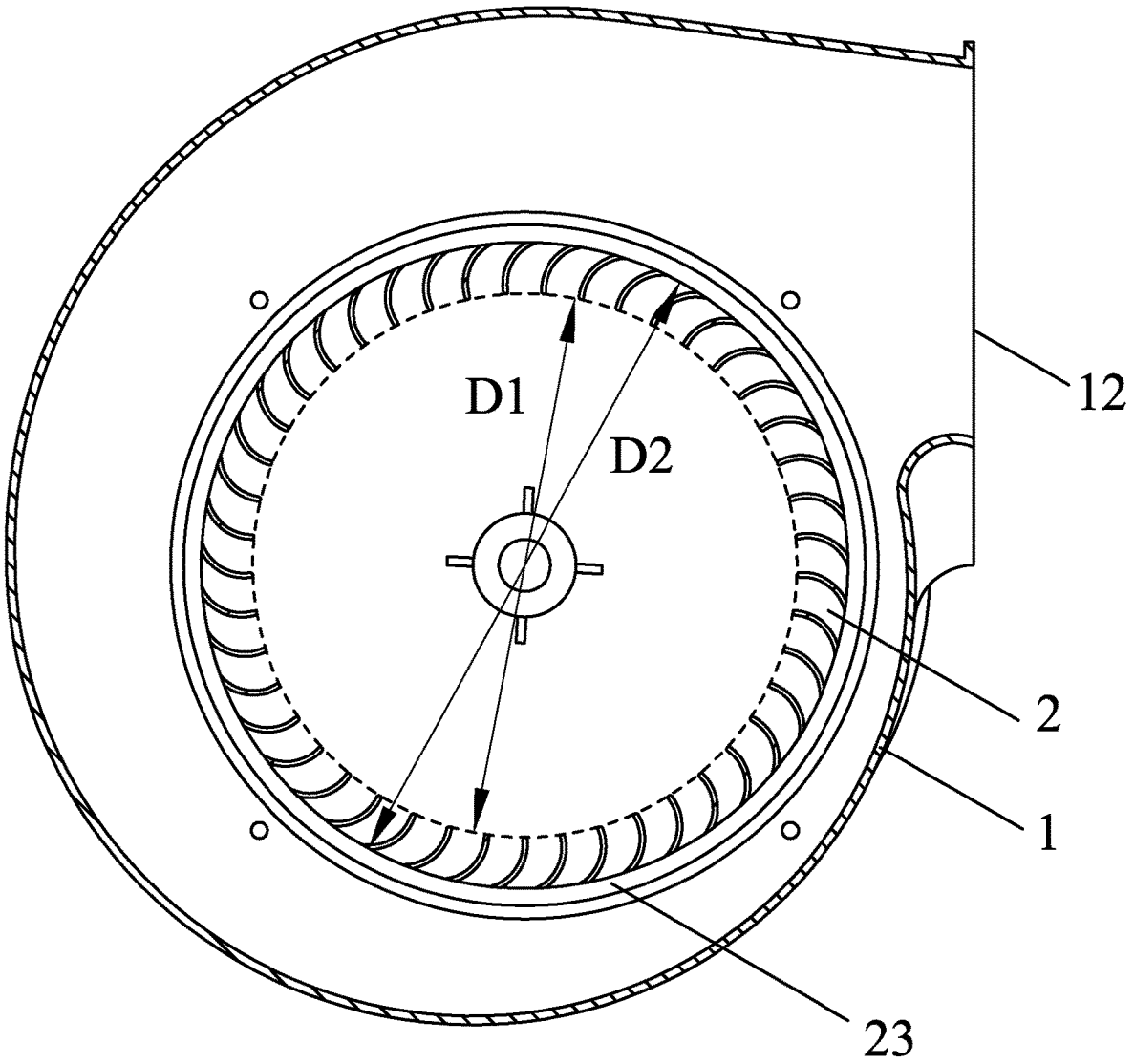
FIG. 8 is a sectional view taken from line VIII-VIII in FIG. 7.
Figure 9:
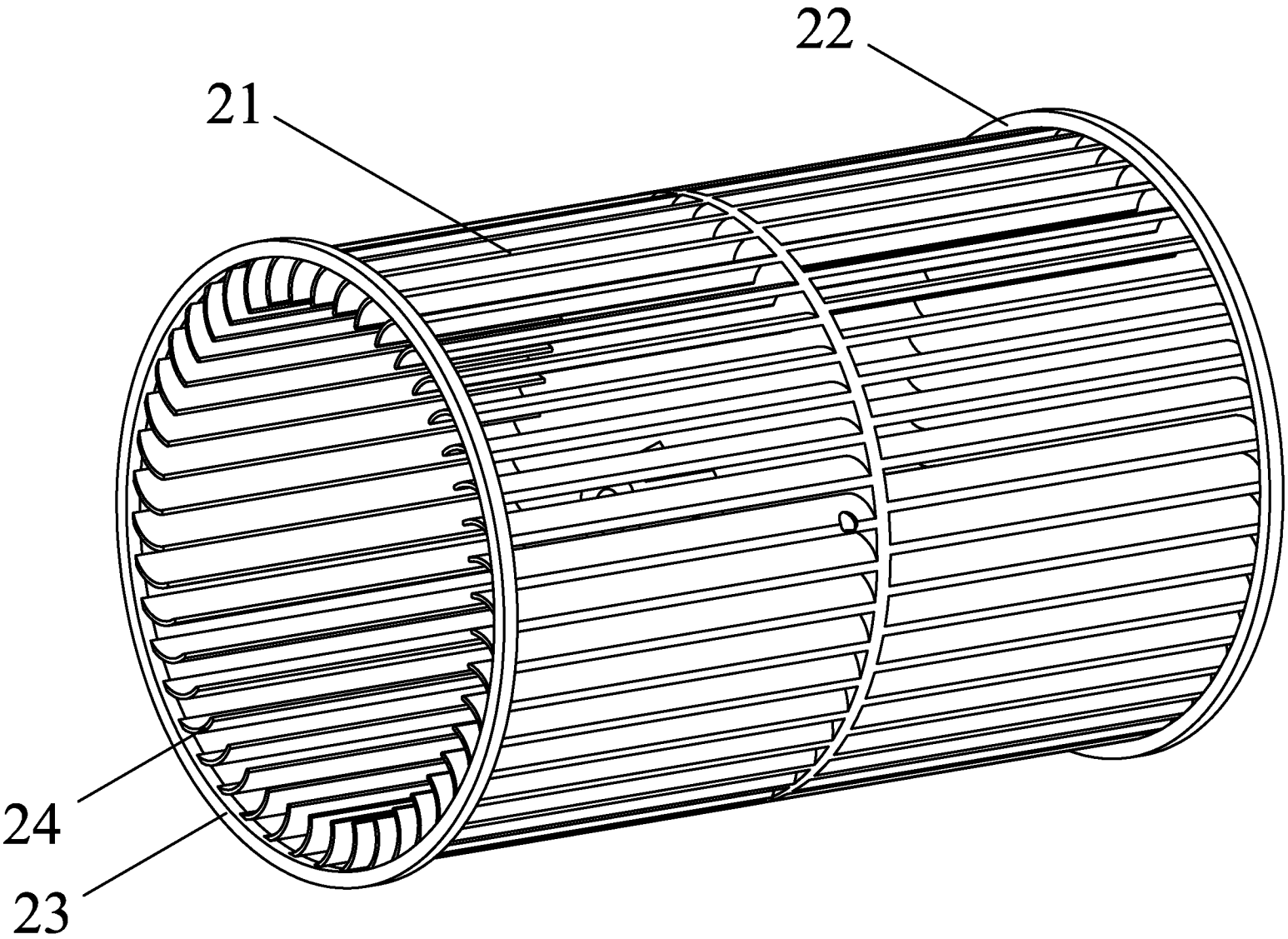
FIG. 9 is a schematic diagram of a wind wheel in accordance with one embodiment of the disclosure.

As shown in FIGS. 3-9, a blower comprises a volute 1 comprising air inlets 11 and an air outlet 12; a wind wheel 2 disposed in the volute 1; tubular air collectors 3 comprising a curved air guide 31. The air inlets 11 are disposed at two sides of the wind wheel 2, respectively. The air collectors 3 correspond to the air inlets. The curved air guide 31 extends into the volute 2, and an inner diameter of the curved air guide 31 decreases stepwise. The relationship between a minimum inner diameter D0 of the curved air guide 31 and an inner diameter D1, an outer diameter D2 of the wind wheel 2 fulfills the following formula: $D1+\frac{1}{3}(D2-D1)\leq D0\leq D1+\frac{2}{3}(D2-D1)$.

The wind wheel comprises an outer surface 21 and an inner surface, two ends of the outer surface 21 protrude outwards radially to form a flange 22; two ends of the inner surface protrude towards the air inlets to form an air-blocking boss 23.

A space 13 is disposed between an end face 24 of the wind wheel 2 and a terminal of the curved air guide 31, and a relationship between a height C1 of the boss 23 and a depth C2 of the space 13 fulfills the following formula: $0<C1\leq\frac{1}{2}C2$.

The relationship between the minimum inner diameter D0 of the curved air guide 31 and the inner diameter D1, the outer diameter D2 of the wind wheel 2 fulfills the following formula: $D0=\frac{1}{2}(D1+D2)$.

To describe this technical scheme in more detail, the overall performances of the blower of the existing technology and the present implementation technology are compared experimentally in Tables 1, 2, 3 and 4.

TABLE 1

Basic parameters for tests

| | | | |
|---|---|---|---|
| Normal atmosphere (hPa) | 1013 | Standard temperature (° C.) | 25 |
| Air density (kg/m$^3$) | 1.1767 | Rotational speed (rpm) | 800 |
| Inner diameter of wind wheel (mm) | 126.2 | Outer diameter of wind wheel (mm) | 150 |
| Space between wind blade and air collector (mm) | 4 | | |

TABLE 2

Overall performance of conventional blowers (D0 = D1 = 126.2 mm, C1 = 0)

| Rotational speed n (rpm) | Air volume Q (m$^3$/h) | Static pressure Ps (Pa) | Output power Lmo (W) | Total pressure Pt (Pa) | Static pressure efficiency $\eta_{sf}$ (−) | Total pressure efficiency $\eta_{tf}$ (−) |
|---|---|---|---|---|---|---|
| 800 | 1391.89 | 0.02 | 37.78 | 9.86 | 0.02 | 10.09 |
| 800 | 1247.95 | 12.12 | 32.78 | 20.03 | 12.81 | 21.18 |
| 800 | 999.17 | 26.92 | 24.46 | 31.99 | 30.55 | 36.31 |
| 800 | 769.54 | 33.62 | 18.83 | 36.63 | 38.17 | 41.58 |
| 800 | 666.67 | 36.05 | 15.87 | 38.30 | 42.07 | 44.71 |
| 800 | 668.00 | 36.70 | 15.70 | 38.82 | 42.70 | 45.30 |
| 800 | 576.99 | 39.17 | 13.94 | 40.86 | 45.04 | 46.98 |
| 800 | 472.64 | 41.37 | 11.35 | 42.51 | 47.84 | 49.15 |
| 800 | 169.83 | 42.24 | 5.30 | 42.38 | 37.62 | 37.74 |

TABLE 3

Overall performance of blower comprising curved air guide with increased minimum inner diameter of the disclosure (D0 = ½ (D1 + D2) = 138.1 mm, C1 = 0)

| Rotational speed n (rpm) | Air volume Q ($m^3$/h) | Static pressure Ps (Pa) | Output power Lmo (W) | Total pressure Pt (Pa) | Static pressure efficiency $\eta_{sf}$ (−) | Total pressure efficiency $\eta_{tf}$ (−) |
|---|---|---|---|---|---|---|
| 800 | 1565.09 | 0.02 | 42.23 | 10.37 | 0.02 | 10.67 |
| 800 | 1418.76 | 13.99 | 36.73 | 22.49 | 15.01 | 24.13 |
| 800 | 1127.27 | 29.30 | 27.40 | 34.66 | 33.48 | 39.61 |
| 800 | 861.70 | 33.85 | 19.78 | 36.99 | 40.97 | 44.76 |
| 800 | 729.02 | 35.88 | 16.96 | 38.12 | 42.83 | 45.51 |
| 800 | 653.20 | 38.71 | 15.15 | 40.51 | 46.35 | 48.51 |
| 800 | 551.07 | 40.50 | 12.72 | 41.78 | 48.73 | 50.28 |
| 800 | 380.09 | 40.83 | 9.10 | 41.44 | 47.38 | 48.09 |
| 800 | 170.62 | 43.07 | 6.05 | 43.19 | 33.74 | 33.84 |

TABLE 4

Overall performance of blower comprising air-blocking boss of the disclosure (D0 = ½ (D1 + D2) = 138.1 mm, C1 = ½ C2 = 2 mm)

| Rotational speed n (rpm) | Air volume Q ($m^3$/h) | Static pressure Ps (Pa) | Output power Lmo (W) | Total pressure Pt (Pa) | Static pressure efficiency $\eta_{sf}$ (−) | Total pressure efficiency $\eta_{tf}$ (−) |
|---|---|---|---|---|---|---|
| 800 | 1547.07 | 0.02 | 41.96 | 11.06 | 0.02 | 11.33 |
| 800 | 1370.45 | 13.11 | 35.13 | 21.77 | 14.21 | 23.60 |
| 800 | 1108.25 | 28.51 | 26.69 | 34.18 | 32.89 | 39.42 |
| 800 | 879.89 | 33.74 | 19.99 | 37.31 | 41.25 | 45.62 |
| 800 | 769.23 | 36.49 | 17.77 | 39.22 | 43.87 | 47.16 |
| 800 | 650.98 | 38.10 | 14.85 | 40.06 | 48.41 | 48.79 |
| 800 | 577.30 | 40.74 | 13.14 | 42.28 | 49.72 | 51.60 |
| 800 | 391.82 | 40.95 | 9.46 | 41.66 | 47.11 | 47.92 |
| 800 | 168.47 | 41.42 | 5.28 | 41.55 | 36.69 | 36.80 |

As shown in the above tables, compared with conventional fans, the blower of the disclosure has less volume loss, higher working efficiency, increased wind resistance between the volute 1 and the space 13, less useless flow of the air, and smaller noise.

Example 2

Figure 10:
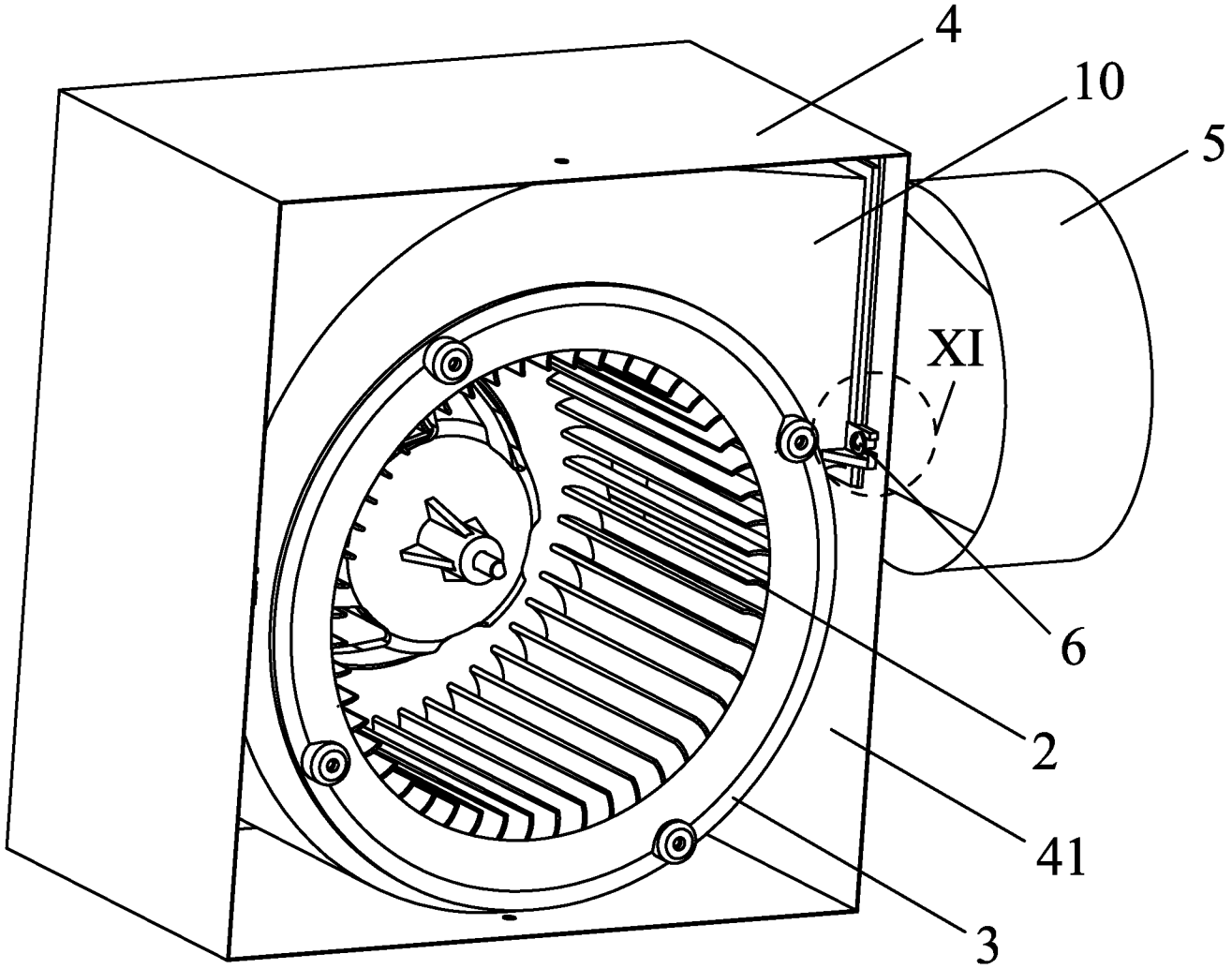
FIG. 10 is a stereogram of an exhaust fan in accordance with one embodiment of the disclosure.
Figure 11:
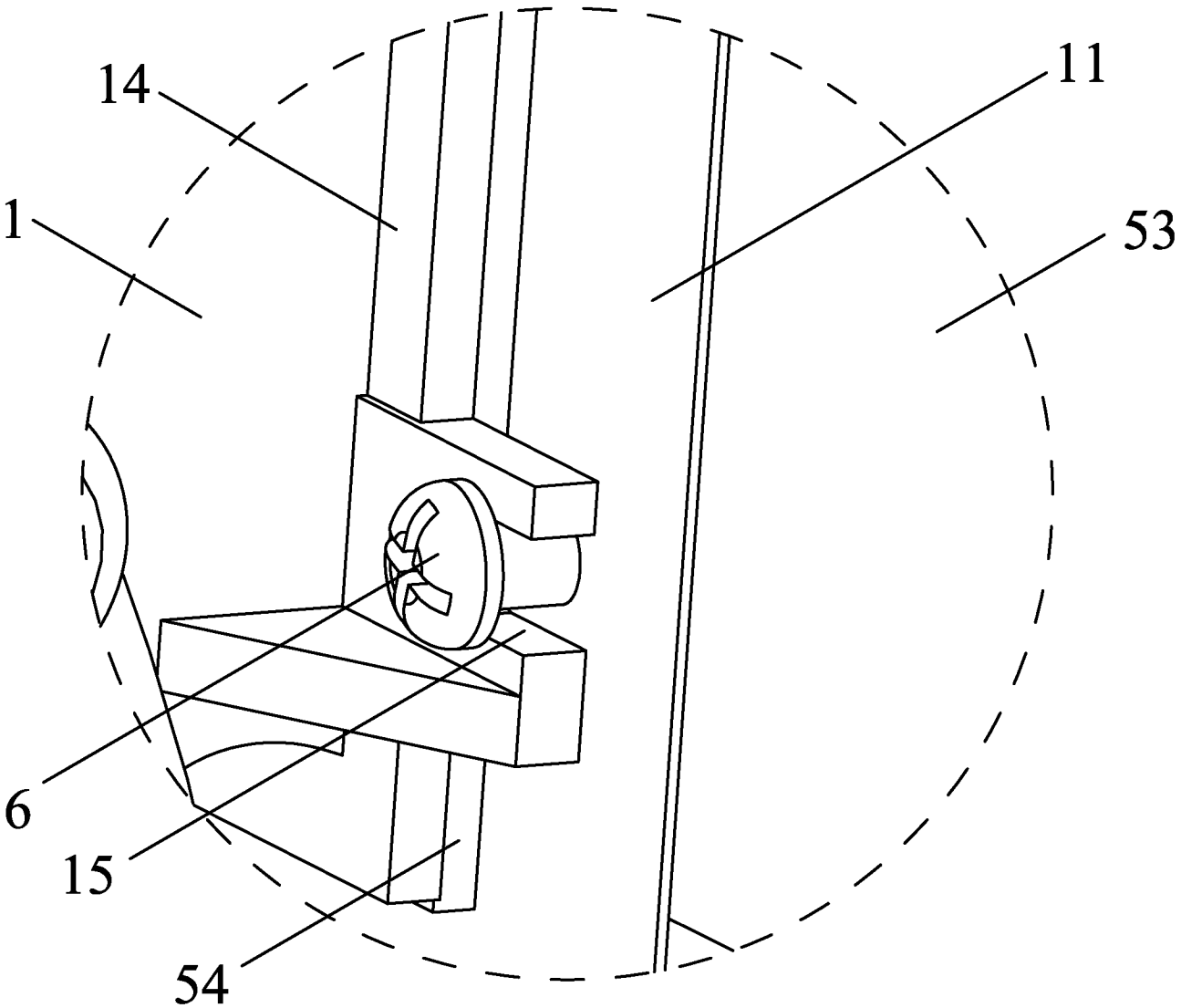
FIG. 11 is an enlarged view of part XI in FIG. 10.
Figure 12:
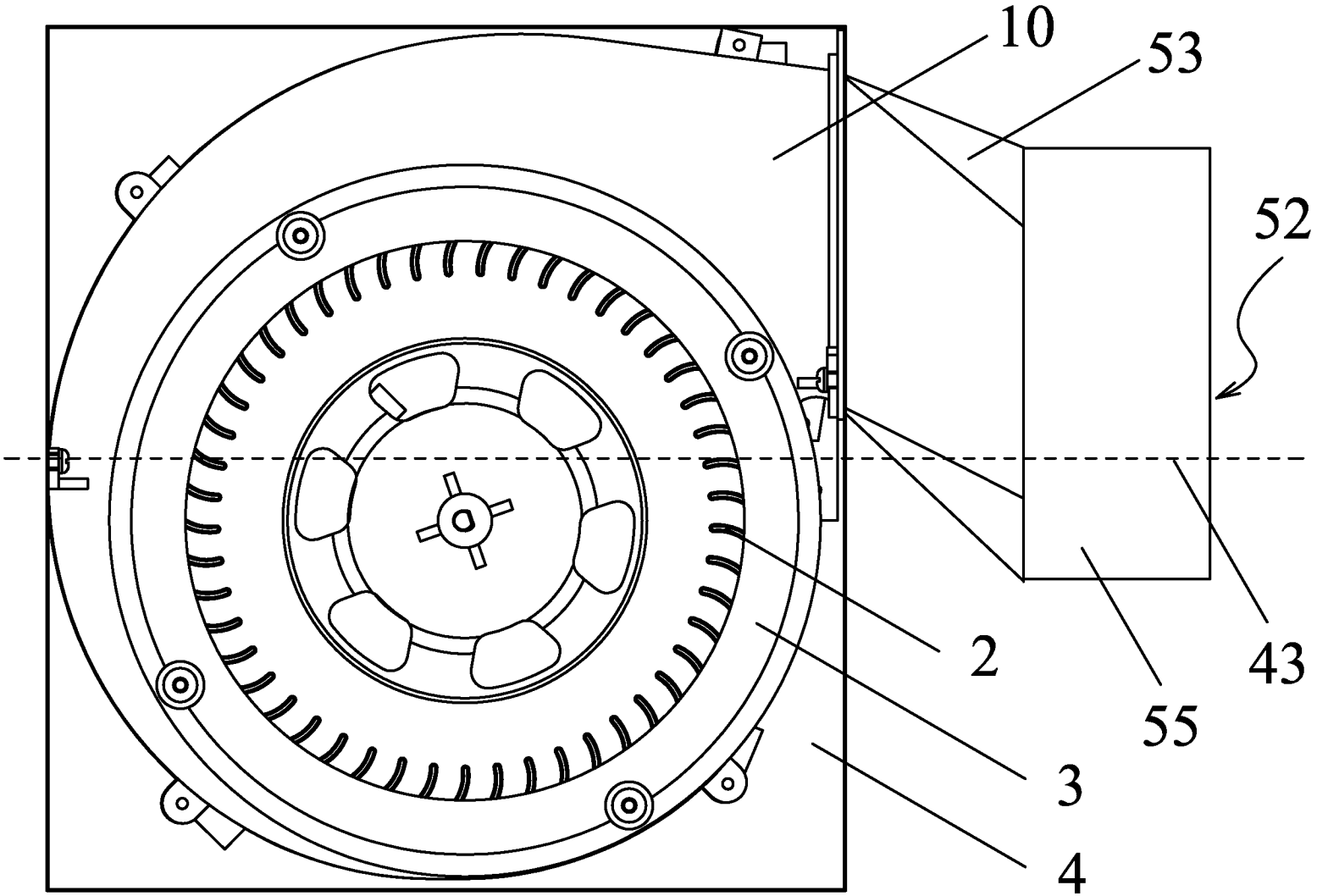
FIG. 12 is a front view of an exhaust fan in accordance with one embodiment of the disclosure.
Figure 13:
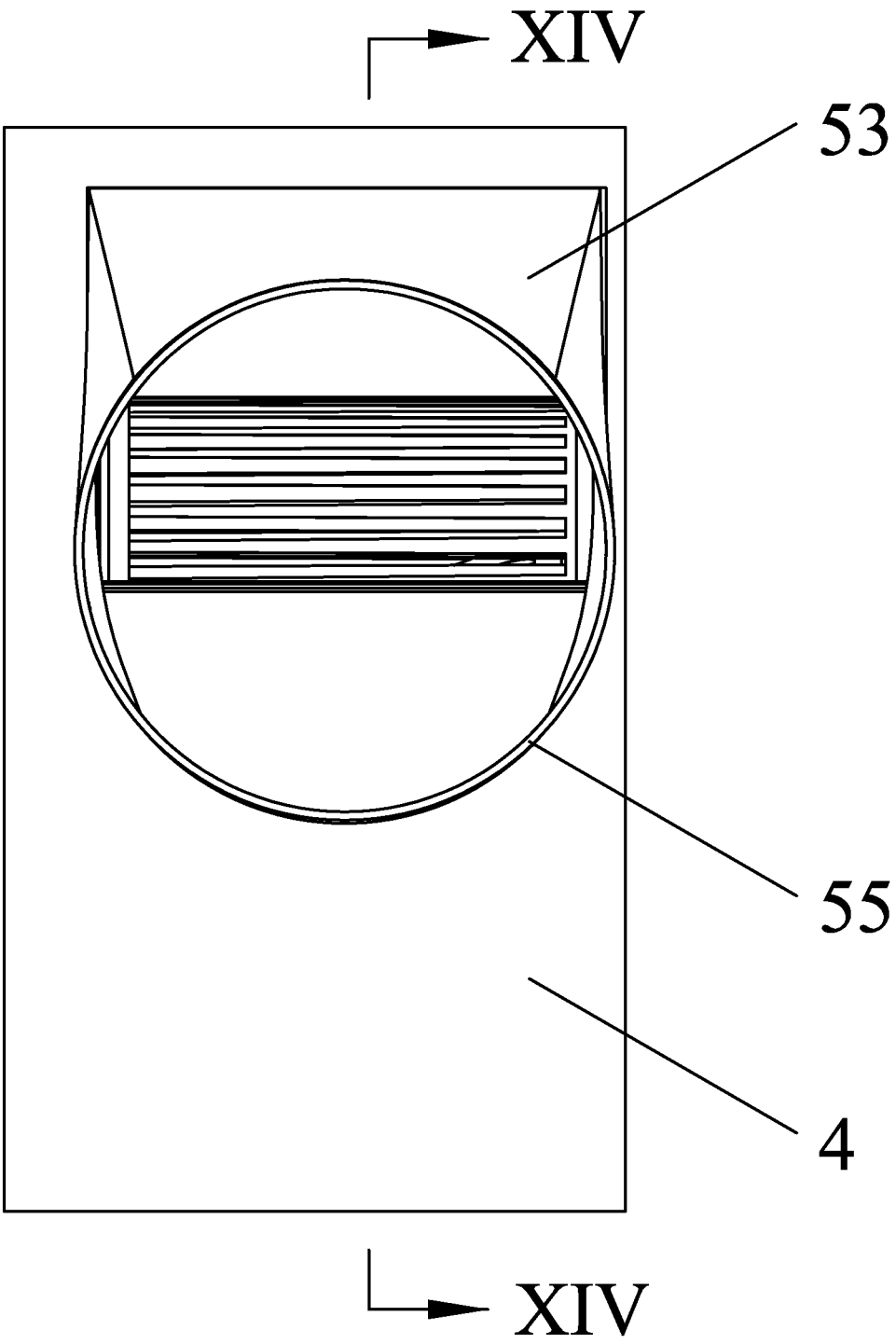
FIG. 13 is a right view of an exhaust fan in accordance with one embodiment of the disclosure.
Figure 14:
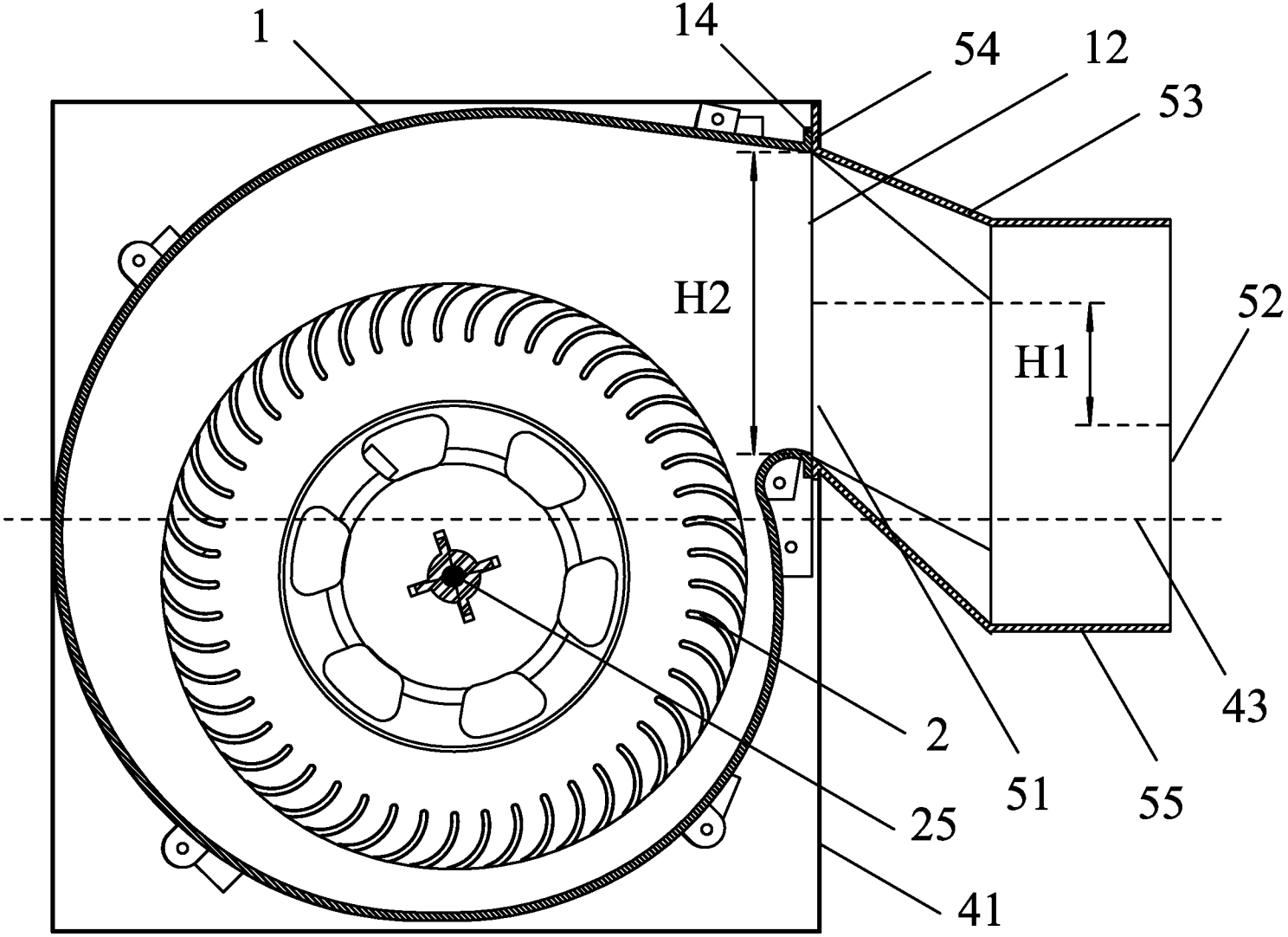
FIG. 14 is a sectional view taken from line XIV-XIV in FIG. 13.
Figure 15:
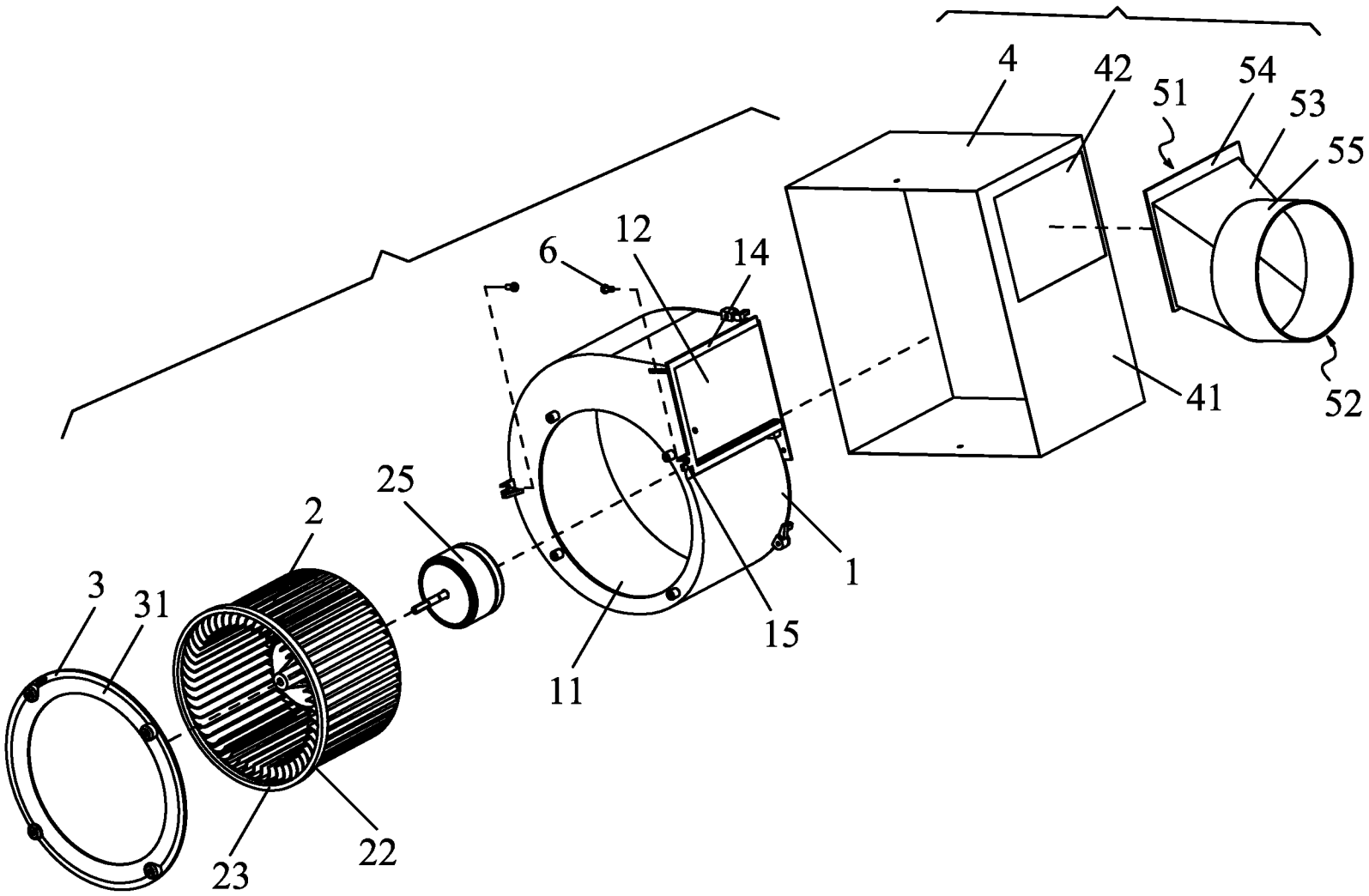
FIG. 15 is an exploded view of an exhaust fan in accordance with one embodiment of the disclosure.

As shown in FIGS. 10-15, an exhaust fan comprises: a box 4 comprising a side wall 41, a blower 10 in Example 1 that is disposed in the box 4, and a transfer tube 5 connected to the side wall of the box 4.

The exhaust fan in the example comprises an upgraded blower 10, so it has higher exhaust efficiency and less noise.

In this example, the box 4 encloses one of the air inlets 11 of the fan 10, and a motor 25 is also mounted in the volute 1. The rotating shaft of the motor 25 is connected to the wind wheel 2.

The transfer tube 5 comprises a tube wall, and a first opening 51 and a second opening 52 that are connected to two ends of the tube wall; the first opening 51 communicates with the air outlet of the volute 1, and the first opening 51 is parallel to the second opening 52; and the second opening 52 shifts towards a horizontal central axis 43 of the box in relation to the air outlet 12. The deviation of the transfer tube 5 towards the horizontal central axis 43 of the box 4 can eliminate the noise and turbulence generated by the vortex at the air outlet 12 of the volute 1. A static pressure plate of the blower 10 is formed at the bottom of the transfer tube 5, with good static pressure recovery effect, improves the static pressure of the blower 10 and the efficiency of the fan 10, and effectively reduces the input power of the motor 25 installed in the blower 10.

Assume a height of the air outlet 12 is H2, and then an offset H1 of a central axis of the second opening 52 shifting towards the horizontal central axis of the box in relation to the air outlet fulfills the following formula: $0.1 \leq H1/H2 \leq 0.5$. Under such circumstances, the effect of noise elimination is the most obvious.

The width of the transfer tube 5 is less than a thickness of the box.

The tube wall comprises a tilt section 53 and a transition section 55; the first opening 51 is located on one end of the tilt section 53, and the second opening 52 is located on one end of the transition section 55; the title section is inclined to the horizontal central axis 43, and the transition section 55 is parallel to the horizontal central axis 43.

The first opening 51 is square in shape, the transition section 55 is a circular tube, and the second opening 52 is circular in shape.

The box 4 comprises a mounting hole 42, the transfer tube 5 is mounted on the box via the mounting hole 42; one end of the transfer tube 5 corresponding to the first opening 51 protrudes outwards to form a first flange 54, and the first flange 54 extends into the box 4.

The box 4 is equipped with a fixed bolt 6, the volute 1 comprises a second flange 14 surrounding the air outlet 12, an edge of the second flange 14 comprises a fixed groove 15 corresponding to the fixed bolt 6; the second flange 14 presses the first flange 54 on the inner surface of the side wall 41 of the box 4, and the volute 4 and the transfer tube 5 are fixed on the box 4 via the fixed bolt 6. Thus, the exhaust fan is a relatively simple structure and is easy to assemble.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A blower, comprising:

a volute comprising two air inlets and an air outlet;

a wind wheel comprising two end surfaces, an outer cylindrical surface having an outer diameter D2, and an inner cylindrical surface having an inner diameter D1;

two air collectors, each air collector comprising a curved air guide having a terminal end surface; and two annular air-blocking bosses;

wherein:

the outer cylindrical surface and the inner cylindrical surface are coaxially disposed, and extend from one of the two end surfaces to the other of two end surfaces;

the wind wheel is disposed within the volute;

the wind wheel is disposed between the two air inlets;

each of the two air collectors is disposed in one of the two air inlets;

the curved air guide extends into the volute, and an inner diameter of the curved air guide decreases in an axial direction toward the wind wheel;

the terminal end surface of each of the two air collectors is disposed adjacent to one of the two end surfaces;

the terminal end surface of each of the two air collectors is separated from one of the two end surfaces that is adjacent to the terminal end surface by a distance C2;

each of the two annular air-blocking bosses protrudes radially outward from the outer cylindrical surface;

each of the two annular air-blocking bosses protrudes axially from one of the two end surfaces toward the terminal end surface that is adjacent to the one of the two end surfaces by a distance C1;

the distance C1 and the distance C2 fulfill the following inequality: $0<C1\leq\frac{1}{2}C2$; and a minimum inner diameter D0 of the curved air guide, the inner diameter D1, and the outer diameter D2 fulfill the following inequality:

$$D1+\tfrac{1}{3}(D2-D1)\leq D0\leq D1+\tfrac{2}{3}(D2-D1).$$

2. The blower of claim 1, wherein the minimum inner diameter D0 of the curved air guide, the inner diameter D1, and the outer diameter D2 fulfill the following inequality: $D0=\frac{1}{2}(D1+D2)$.

3. An exhaust fan, comprising: a box comprising a side wall, a blower of claim 1 that is disposed in the box, and a transfer tube connected to the side wall of the box.

4. The fan of claim 3, wherein:

the transfer tube comprises a tube wall, and a first opening and a second opening that are respectively disposed at two ends of the tube wall;

the first opening is connected with the air outlet of the volute, and a central axis of the first opening aligns with a central axis of the air outlet of the volute;

the central axis of the first opening and a central axis of the second opening are parallel to a central axis of the box;

the central axis of the second opening is offset from the central axis of the first opening towards the central axis of the box by an offset distance H1.

5. The fan of claim 4, wherein a height H2 of the air outlet and the offset distance H1 fulfill the following formula: inequality: $0.1\leq H1/H2\leq 0.5$.

6. The fan of claim 5, wherein a width of the transfer tube is less than a thickness of the box.

7. The fan of claim 6, wherein the tube wall comprises a tilt section and a transition section; the first opening is located on one end of the tilt section, and the second opening is located on one end of the transition section; the title section is inclined to the central axis of the box, and the transition section is parallel to the central axis of the box.

8. The fan of claim 7, wherein the first opening is square in shape, the transition section is a circular tube, and the second opening is circular in shape.

9. The fan of claim 3, wherein the box comprises a mounting hole, the transfer tube is mounted on the box via the mounting hole; one end of the transfer tube protrudes outwards to form a first flange, the first flange is fixed on an inner surface of the side wall of the box.

10. The fan of claim 4, wherein the box comprises a mounting hole, the transfer tube is mounted on the box via the mounting hole; one end of the transfer tube having the first opening protrudes outwards to form a first flange, the first flange is fixed on an inner surface of the side wall of the box, and the second opening is outside the box.

11. The fan of claim 5, wherein the box comprises a mounting hole, the transfer tube is mounted on the box via the mounting hole; one end of the transfer tube having the first opening protrudes outwards to form a first flange, the first flange is fixed on an inner surface of the side wall of the box, and the second opening is outside the box.

12. The fan of claim 6, wherein the box comprises a mounting hole, the transfer tube is mounted on the box via the mounting hole; one end of the transfer tube having the first opening protrudes outwards to form a first flange, the first flange is fixed on an inner surface of the side wall of the box, and the second opening is outside the box.

13. The fan of claim 7, wherein the box comprises a mounting hole, the transfer tube is mounted on the box via the mounting hole; one end of the tilt section having the first opening protrudes outwards to form a first flange, the first flange is fixed on an inner surface of the side wall of the box, and the tilt section and the second opening are outside the box.

14. The fan of claim 8, wherein the box comprises a mounting hole, the transfer tube is mounted on the box via the mounting hole; one end of the tilt section having the first opening protrudes outwards to form a first flange, the first flange is fixed on an inner surface of the side wall of the box, and the tilt section and the second opening are outside the box.

15. The fan of claim 9, wherein the box is equipped with a fixed bolt, the volute comprises a second flange surrounding the air outlet, an edge of the second flange comprises a fixed groove corresponding to the fixed bolt; the second flange presses the first flange on the inner surface of the side wall of the box, and the volute and the transfer tube are fixed on the box via the fixed bolt.

16. The fan of claim 14, wherein the box is equipped with a fixed bolt, the volute comprises a second flange surrounding the air outlet, an edge of the second flange comprises a fixed groove corresponding to the fixed bolt; the second flange presses the first flange on the inner surface of the side wall of the box, and the volute and the transfer tube are fixed on the box via the fixed bolt.

* * * * *